US006099178A

United States Patent [19]

Spurr et al.

[11] Patent Number: 6,099,178

[45] Date of Patent: Aug. 8, 2000

[54] PRINTER WITH MEDIA SUPPLY SPOOL ADAPTED TO SENSE TYPE OF MEDIA, AND METHOD OF ASSEMBLING SAME

[75] Inventors: Robert W. Spurr; Kurt M. Sanger; Babak B. Tehranchi, all of Rochester; Timothy J. Tredwell, Fairport, all of N.Y.

[73] Assignee: Eastman Kodak Company, Rochester, N.Y.

[21] Appl. No.: 09/133,114

[22] Filed: Aug. 12, 1998

[51] Int. Cl.[7] ..... B41J 35/28

[52] U.S. Cl. ..... 400/207; 400/208; 400/242; 347/214

[58] Field of Search ..... 400/120.02, 208, 400/208.1, 207, 242, 249, 613, 708; 347/214

[56] References Cited

U.S. PATENT DOCUMENTS

| | | | |
|---|---|---|---|
| 4,129,855 | 12/1978 | Rodrian | 340/825.4 |
| 4,247,758 | 1/1981 | Rodian | 376/6 |
| 4,806,958 | 2/1989 | Momot et al. | 354/21 |
| 4,880,325 | 11/1989 | Ueda et al. | 400/249 |
| 5,184,152 | 2/1993 | French | 347/197 |
| 5,185,315 | 2/1993 | Sparer | 400/208 |
| 5,196,846 | 3/1993 | Brockelsby | 340/933 |
| 5,268,708 | 12/1993 | Harshbarger et al. | 346/134 |
| 5,297,881 | 3/1994 | Ishiyama | 400/705 |
| 5,305,020 | 4/1994 | Gibbons et al. | 347/177 |
| 5,331,338 | 7/1994 | Mager | 347/248 |
| 5,342,671 | 8/1994 | Stephenson | 428/195 |
| 5,385,416 | 1/1995 | Maekawa et al. | 400/208 |
| 5,426,011 | 6/1995 | Stephenson | 430/22 |
| 5,455,617 | 10/1995 | Stephenson et al. | 347/214 |
| 5,491,327 | 2/1996 | Saroya | 235/449 |
| 5,493,385 | 2/1996 | Ng | 399/40 |
| 5,513,920 | 5/1996 | Whritenor et al. | 400/246 |
| 5,562,352 | 10/1996 | Whritenor et al. | 400/262 |
| 5,565,906 | 10/1996 | Schoon | 347/248 |
| 5,598,201 | 1/1997 | Stodder et al. | 347/104 |
| 5,600,350 | 2/1997 | Cobbs et al. | 347/19 |
| 5,600,352 | 2/1997 | Knierim et al. | 347/40 |
| 5,620,265 | 4/1997 | Kondo | 400/196 |
| 5,647,679 | 7/1997 | Green et al. | 400/232 |
| 5,661,515 | 8/1997 | Hevenor et al. | 347/215 |
| 5,713,288 | 2/1998 | Frazzitta | 101/492 |
| 5,755,519 | 5/1998 | Klinefelter | 400/249 |
| 5,774,639 | 6/1998 | Schildkraut et al. | 395/115 |

*Primary Examiner*—John S. Hilten
*Assistant Examiner*—Minh H. Chau
*Attorney, Agent, or Firm*—Walter S. Stevens

[57] ABSTRACT

A printer with media supply spool adapted to sense type of media, and method of assembling same. A supply spool to be loaded into the printer is adapted to allow the printer to sense type of a media ribbon thereon. The supply spool comprises a shaft having a supply of media ribbon wound thereabout. A transceiver unit is disposed proximate the shaft. The transceiver is capable of transmitting a first electromagnetic field and sensing a second electromagnetic field. A transponder including a semi-conductor chip is integrally connected to the shaft and has encoded data previously stored therein indicative of the type of media ribbon. The chip is capable of receiving the first electromagnetic field to power the chip and then generating the second electromagnetic field as the chip is powered. The second electromagnetic field is characteristic of the data previously stored in the chip. The transceiver unit senses the second electromagnetic field, which second electromagnetic field has the data subsumed in the chip. The printer then operates in accordance with the data sensed by the transceiver to produce quality prints consistent with the type of donor being used.

20 Claims, 4 Drawing Sheets

PRINTER WITH MEDIA SUPPLY SPOOL ADAPTED TO SENSE TYPE OF MEDIA, AND METHOD OF ASSEMBLING SAME

BACKGROUND OF THE INVENTION

This invention generally relates to printer apparatus and methods and more particularly relates to a printer and media supply spool adapted to sense type of media, and method of assembling same.

Pre-press color proofing is a procedure that is used by the printing industry for creating representative images of printed material. This procedure avoids the high cost and time required to actually produce printing plates and also avoids setting-up a high-speed, high-volume, printing press to produce a single example of an intended image. Otherwise, in the absence of pre-press proofing, the intended image may require several corrections and be reproduced several times to satisfy customer requirements. This results in loss of profits. By utilizing pre-press color proofing time and money are saved.

A laser thermal printer having half-tone color proofing capabilities is disclosed in commonly assigned U.S. Pat. No. 5,268,708 titled "Laser Thermal Printer With An Automatic Material Supply" issued Dec. 7, 1993 in the name of R. Jack Harshbarger, et al. The Harshbarger, et al. device is capable of forming an image on a sheet of thermal print media by transferring dye from a roll (i.e., web) of dye donor material to the thermal print media. This is achieved by applying a sufficient amount of thermal energy to the dye donor material to form the image on the thermal print media. This apparatus generally comprises a material supply assembly, a lathe bed scanning subsystem (which includes a lathe bed scanning frame, a translation drive, a translation stage member, a laser printhead, and a vacuum imaging drum), and exit transports for exit of thermal print media and dye donor material from the printer.

The operation of the Harshbarger, et al. apparatus comprises metering a length of the thermal print media (in roll form) from the material supply assembly. The thermal print media is then measured and cut into sheet form of the required length, transported to the vacuum imaging drum, registered, and then wrapped around and secured onto the vacuum imaging drum. Next, a length of dye donor roll material is also metered out of the material supply assembly, measured and cut into sheet form of the required length. The cut sheet of dye donor roll material is then transported to and wrapped around the vacuum imaging drum, such that it is superposed in registration with the thermal print media, which at this point has already been secured to the vacuum imaging drum.

Harshbarger, et al. also disclose that after the dye donor material is secured to the periphery of the vacuum imaging drum, the scanning subsystem and laser write engine provide the previously mentioned scanning function. This is accomplished by retaining the thermal print media and the dye donor material on the spinning vacuum imaging drum while the drum is rotated past the print head that will expose the thermal print media. The translation drive then traverses the print head and translation stage member axially along the rotating vacuum imaging drum in coordinated motion with the rotating vacuum imaging drum. These movements combine to produce the image on the thermal print media.

According to the Harshbarger, et al. disclosure, after the intended image has been written on the thermal print media, the dye donor material is then removed from the vacuum imaging drum. This is done without disturbing the thermal print media that is beneath the dye donor material. The dye donor material is then transported out of the image processing apparatus by the dye donor exit transport. Additional dye donor materials are sequentially superposed with the thermal print media on the vacuum imaging drum, then imaged onto the thermal print media as previously mentioned, until the intended full-color image is completed. The completed image on the thermal print media is then unloaded from the vacuum imaging drum and transported to an external holding tray associated with the image processing apparatus by the print media exit transport. However, Harshbarger, et al. do not appear to disclose appropriate means for informing the printer of type of donor material loaded into the printer, so that high quality images are obtained.

The previously mentioned dye donor web is typically wound about a donor supply shaft to define a donor spool, which is loaded into the printer. However, it is desirable to match the specific type donor web with a specific printer, so that high quality images are obtained. For example, it is desirable to inform the printer of the dye density comprising the donor web, so that the laser write head applies an appropriate amount of heat to the web in order to transfer the proper amount of dye to the thermal print media. Also, it is desirable to verify that the donor spool is not loaded backwards into the printer. This is desirable because, if the donor spool is loaded backwards into the printer, the donor sheet may be propelled off the rotating drum at high speed or the dye present on the donor material may transfer to a lens included in an optical system belonging to the printer. Either of these results can cause catastrophic damage to the printer, thereby increasing printing costs. For example, a replacement for a damaged lens typically will cost several thousands of dollars. In addition, it is also desirable to know number of frames (i.e., pages) remaining on a partially used donor web. This is desirable because it is often necessary to exchange a partially used roll of donor web for a full roll of donor web for overnight printing, so that the printer can operate unattended. However, unattended operation of the printer requires precise media inventory control. That is, the printer is preferably loaded with a full roll of donor material in order that the printer does not stop printing due to lack of donor material during an unattended extended time period (e.g., overnight printing). Therefore, a further problem in the art is insufficient donor material being present during unattended extended operation of the printer.

Also, in order to properly calibrate the printer, an operator of the printer determines the characteristics of the donor web (e.g., dye density, number of frames remaining on the donor web, e.t.c.) and manually programs the printer with this information to accommodate the specific dye donor web being used. However, manually programming the printer is time consuming and costly. Moreover, the operator may make an error when he manually programs the printer. Therefore, another problem in the art is time consuming and costly manual programming of the printer to accommodate the specific dye donor web being used. An additional problem in the art is operator error associated with manual programming of the printer.

A donor supply spool obviating need to manually program a resistive head thermal printer with frame count information is disclosed in commonly assigned U.S. Pat. No. 5,455,617 titled "Thermal Printer Having Non-Volatile Memory" issued Oct. 3, 1995 in the name of Stanley W. Stephenson, et al. This patent discloses a web-type dye carrier for use in a thermal resistive head printer and a cartridge for the dye carrier. The dye carrier is driven along a path from a supply spool and onto a take-up spool.

Mounted on the cartridge is a non-volatile memory programmed with information, including characteristics of the carrier. A two-point electrical communication format allows for communication to the memory in the device. In this regard, two electrically separated contacts disposed within the printer provide a communication link between the printer and cartridge when the cartridge is inserted into the thermal resistive head printer. Moreover, according to the Stephenson et al. patent, communication between the cartridge and printer can also be accomplished by use of opto-electrical or radio frequency communications. Although the Stephenson et al. patent indicates that communication between the cartridge and printer can be accomplished by use of opto-electrical or radio frequency communications, the Stephenson et al. patent does not appear to disclose specific structure to accomplish the opto-electrical or radio frequency communications.

Therefore, there has been a long-felt need to provide a printer with media supply spool adapted to sense type of media, and method of assembling same.

SUMMARY OF THE INVENTION

An object of the present invention is to provide a printer with media supply spool adapted to remotely sense type of media, and method of assembling same.

With this object in view, the present invention resides in a printer adapted to sense type of media thereon, comprising a radio frequency transceiver for transmitting a first electromagnetic field and for sensing a second electromagnetic field; and a memory spaced-apart from said radio frequency transceiver and having data stored therein indicative of the type of media, said memory capable of receiving the first electromagnetic field and generating the second electromagnetic field in response to the first electromagnetic field received thereby, the second electromagnetic field being characteristic of the data stored in said memory.

According to an embodiment of the present invention, a supply spool, which is adapted to sense type of a media ribbon thereon, comprises a shaft having a supply of the media ribbon wound thereabout. A radio frequency transceiver unit is disposed proximate the shaft. The radio frequency transceiver unit is capable of transmitting a first electromagnetic field of a predetermined first radio frequency. The radio frequency transceiver is also capable of sensing a second electromagnetic field of a predetermined second radio frequency. An EEPROM (i.e., Electrically Erasable Programmable Read Only Memory) semiconductor chip is contained in a transponder that is integrally connected to the shaft and has encoded data stored therein indicative of the type of donor ribbon wound about the shaft. The chip is capable of receiving the first electromagnetic field to power the chip. When the chip is powered, the chip generates the second electromagnetic field. The second electromagnetic field is characteristic of the encoded data previously stored in the chip. In this manner, the radio frequency transceiver unit senses the second electromagnetic field as the chip generates the second electromagnetic field, which second electromagnetic field has the media data subsumed therein. The printer then operates in accordance with the data sensed by the radio frequency transceiver to produce the intended image.

A feature of the present invention is the provision of a radio frequency transceiver capable of transmitting a first electromagnetic field to be intercepted by a transponder having data stored therein indicative of the media, the transponder capable of generating a second electromagnetic field to be sensed by the radio frequency transceiver.

An advantage of the present invention is that use thereof eliminates manual data entry when loading a media ribbon spool into the printer.

Another advantage of the present invention is that use thereof automatically calculates number of pages (i.e., frames) remaining on a partially used donor spool.

Yet another advantage of the present invention is that use thereof allows for optimum image reproduction by allowing automatic calibration of the printer according to the specific type of donor ribbon loaded therein so as to reduce need for a plurality of calibrated proofs.

Still another advantage of the present invention is that the printer includes a non-contacting radio frequency transceiver to detect type of donor spool; that is, the radio frequency transceiver is positioned remotely from the donor spool and does not contact the donor spool.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the invention. It is to be understood that elements not specifically shown or described may take various forms well known to those skilled in the art.

Figure 1:
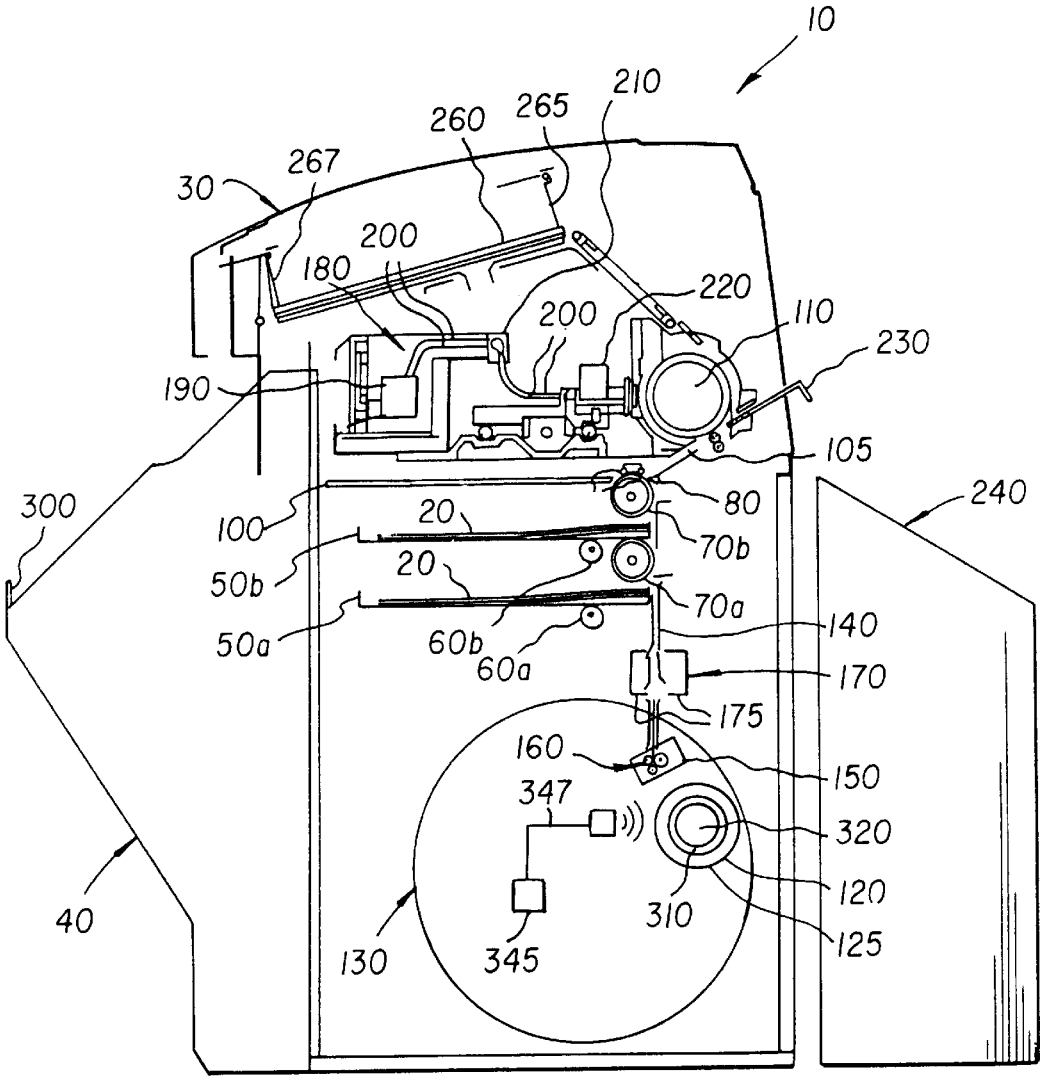
FIG. 1 is a view in vertical section of a printer belonging to the invention, this view showing a dye donor spool having a media ribbon wound thereabout and also showing a media carousel.
Figure 2:
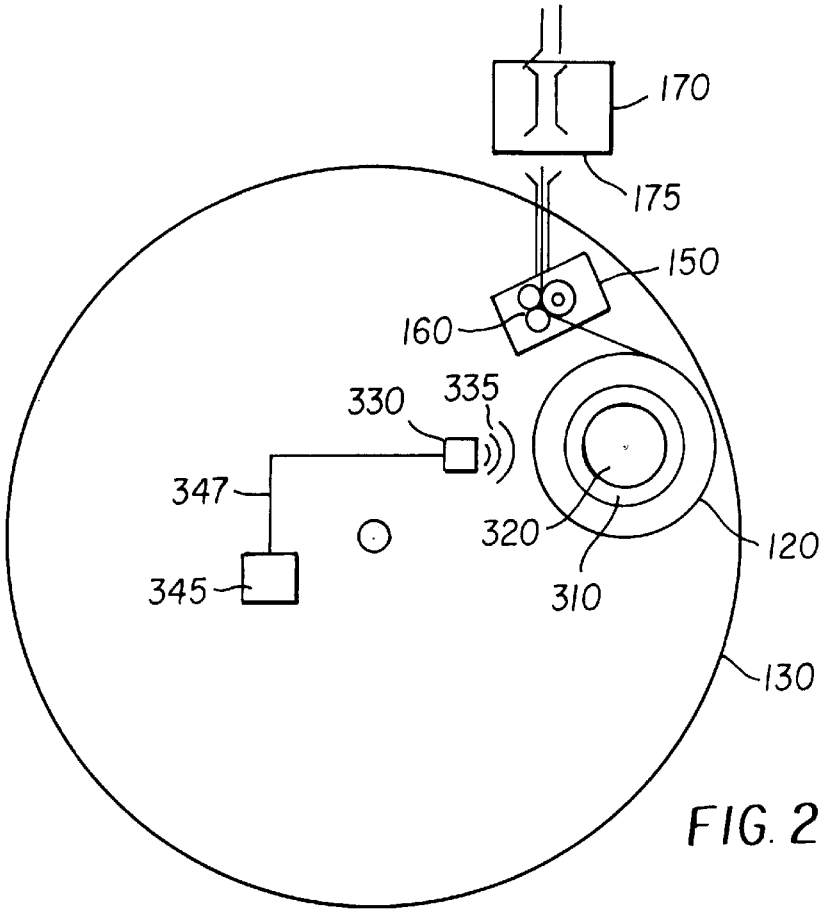
FIG. 2 is an enlarged view in elevation of the dye donor spool and media carousel.

Therefore, referring to FIGS. 1 and 2, there is shown a laser thermal printer, generally referred to as 10, for forming an image (not shown) on a thermal print media 20 which may be cut sheets of paper or transparency. Printer 10 includes a housing 30 for housing components belonging to printer 10. More specifically, a movable, hinged door 40 is attached to a front portion of housing 30 permitting access to a lower thermal print media sheet supply tray 50*a* and an upper sheet supply tray 50*b*. Supply trays 50*a*/50*b*, which are positioned in an interior portion of housing 30, support thermal print media 20 thereon. Only one of sheet supply trays 50*a*,50*b* dispenses thermal print media 20 out of its sheet supply tray to create an image thereon. The alternate one of sheet supply trays 50*a*, 50*b* either holds an alternative type of thermal print media 20 or functions as a back-up sheet supply tray. More specifically, lower sheet supply tray 50*a* includes a lower media lift cam 60*a* for lifting lower sheet supply tray 50*a*, and ultimately thermal print media 20, upwardly toward a rotatable lower media roller 70*a* and also toward a rotatable upper media roller 70*b*. When both rollers 70*a*/*b* are rotated, rollers 70*a*/*b* enable thermal print media 20 in lower sheet supply tray 50*a* to be pulled upwardly towards a movable media guide 80. Moreover, upper sheet supply tray 50*b* includes an upper media lift cam 60*b* for lifting upper sheet supply tray 50*b*, and ultimately thermal print media 20, towards the upper media roller 70*b* which directs print media 20 towards media guide 80.

Referring again to FIGS. 1 and 2, media guide 80 directs thermal print media 20 under a pair of media guide rollers 90. In this regard, media guide rollers 90 engage thermal print media 20 for assisting upper media roller 70*b*, so as to direct print media 20 onto a media staging tray 100. An end of media guide 80 is rotated downwardly, as illustrated in the position shown, and the direction of rotation of upper media roller 70*b* is reversed. Reversing direction of rotation of upper media roller 70*b* moves thermal print media 20, which is resting on media staging tray 100, to a position under the pair of media guide rollers 90, upwardly through an entrance passageway 105 and around a rotatable vacuum imaging drum 110. At this point, thermal print media 20 rests on drum 110.

Still referring to FIGS. 1 and 2, a generally cylindrical dye media supply spool 120 of media material 125 is connected to a media carousel 130 in a lower portion of housing 30. Preferably, four media spools 120 are used, but only one is shown for clarity. Each of the four spools 120 includes media material 125 of a different color, such as cyan, magenta, yellow and black (CMYB). Also it may be understood from the teachings herein that media spool 120 may have a receiver ribbon wrapped thereabout rather than dye media ribbon 120 for use in a printer having appropriate structure to accept such a spool wrapped with receiver. An advantage for having receiver ribbon (i.e., thermal print media) wrapped about a media spool is that such an arrangement conserves space within the printer. Thus, the invention is usable in connection with a thermal print (i.e., receiver) media spool for characterizing the print media (e.g., smoothness of the print media, or whether the print media is paper, film, metallic plates, or other material capable of accepting an image). Also, it may be appreciated that the invention is not limited to use of four media spools 120, because more or fewer media spools 120 may be used. These media materials 125 are ultimately cut into dye donor sheets 140 and passed to vacuum imaging drum 110 for forming donor medium from which dyes imbedded therein are passed to thermal print media 20. Also, it may be understood that the terminology "dye" is intended herein to include any type of colorant, such as pigments.

Referring again to FIGS. 1 and 2, the process of passing colorants (e.g., dyes) to thermal print media 20 will now be described. In this regard, a media drive mechanism 150 is attached to each spool 120, and includes three media drive rollers 160 through which media material 125 is metered upwardly into a media knife assembly 170. After media material 125 reaches a predetermined position, media drive rollers 160 cease driving media material 125. At this point, a plurality (e.g., two) of media knife blades 175 positioned at a bottom portion of media knife assembly 170 cut media material 125 into dye donor sheets 140. Lower media roller 70*a* and upper media roller 70*b* along with media guide 80 then pass dye donor sheets 140 onto media staging tray 100 and ultimately onto vacuum imaging drum 110. Of course, dye donor sheets 140 are passed onto drum 110 in registration with thermal print media 20. At this point, dye donor sheet 140 now rests atop thermal print media 20. This process of passing dye donor sheets 140 onto vacuum imaging drum 110 is substantially the same process as described hereinabove for passing thermal print media 20 onto vacuum imaging drum 110.

Referring yet again to FIGS. 1 and 2, a laser assembly, generally referred to as 180, includes a quantity of laser diodes 190. Laser diodes 190 are connected by means of fiber optic cables 200 to a distribution block 210 and ultimately to a printhead 220. Printhead 220 directs thermal energy received from laser diodes 190 and causes dye donor sheet 140 to pass the desired color to thermal print media 20. Moreover, printhead 220 is movable with respect to vacuum imaging drum 110, and is arranged to direct a beam of laser light to dye donor sheet 140. For each laser diode 190, the beam of light from printhead 220 is individually modulated by modulated electronic signals, which signals are representative of the shape and color of the original image. In this manner, dye donor sheet 140 is heated to cause volatilization only in those areas of thermal print media 20 necessary to reconstruct the shape and color of the original image. In addition, it may be appreciated that printhead 220 is attached to a lead screw (not shown) by means of a lead screw drive nut (not shown) and drive coupling (also not shown) for permitting movement axially along the longitudinal axis of vacuum imaging drum 110 in order to transfer data that creates the desired image on thermal print media 20.

Again referring to FIGS. 1 and 2, drum 110 rotates at a constant velocity. Travel of printhead 220 begins at one end of thermal print media 20 and traverses the entire length of thermal print media 20 for completing the dye transfer process for the dye donor sheet 140 resting on thermal print media 20. After printhead 220 has completed the transfer process for the dye donor sheet 140 resting on thermal print media 20, dye donor sheet 140 is then removed from vacuum imaging drum 110 and transferred out of housing 30 by means of an ejection chute 230. Dye donor sheet 140 eventually comes to rest in a waste bin 240 for removal by an operator of printer 10. The above described process is then repeated for the other three spools 120 of media materials 125.

Still referring to FIGS. 1 and 2, after colorants from the four media spools 120 have been transferred and the dye donor sheets 140 have been removed from vacuum imaging drum 110, thermal print media 20 is removed from vacuum imaging drum 110 and transported by means of a transport mechanism 250 to a color binding assembly 260. An entrance door 265 of color binding assembly 260 is opened for permitting thermal print media 20 to enter color binding assembly 260, and shuts once thermal print media 20 comes to rest in color binding assembly 260. Color binding assembly 260 processes thermal print media 20 for further binding the colors transferred to thermal print media 20. After the color binding process has been completed, a media exit door 267 is opened and thermal print media 20 with the intended image thereon passes out of color binding assembly 260 and housing 30 and thereafter comes to rest against a media stop 300. Such a printer 10 is disclosed in U.S. patent application Ser. No. 08/883,058 titled "A Method Of Precision Finishing A Vacuum Imaging Drum" filed Jun. 26, 1997 in the name of Roger Kerr, the disclosure of which hereby incorporated by reference.

Figure 3:
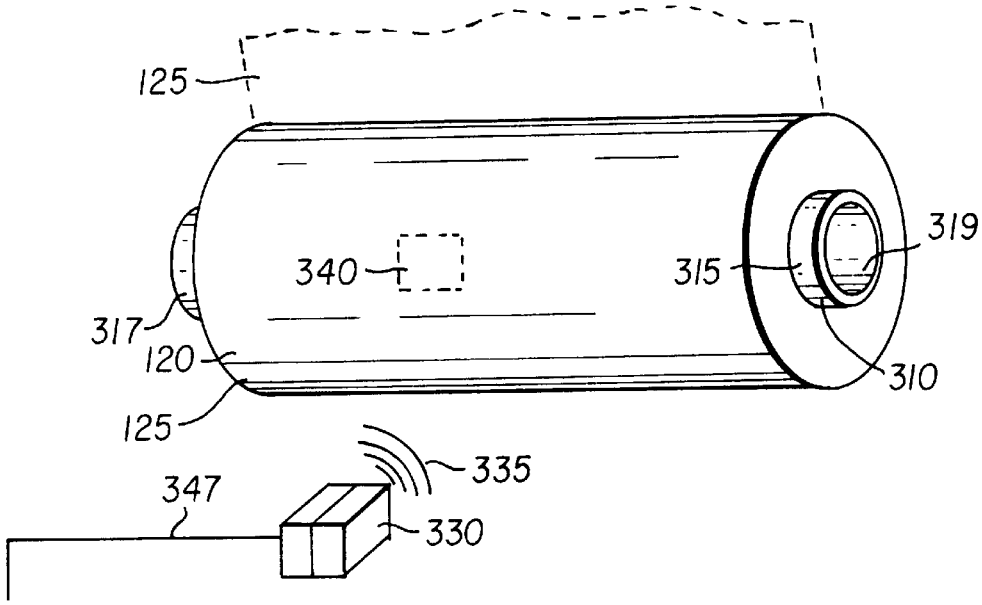
FIG. 3 is a view in perspective of the dye donor spool, the dye donor spool also having a transponder chip integrally connected thereto.
Figure 4:
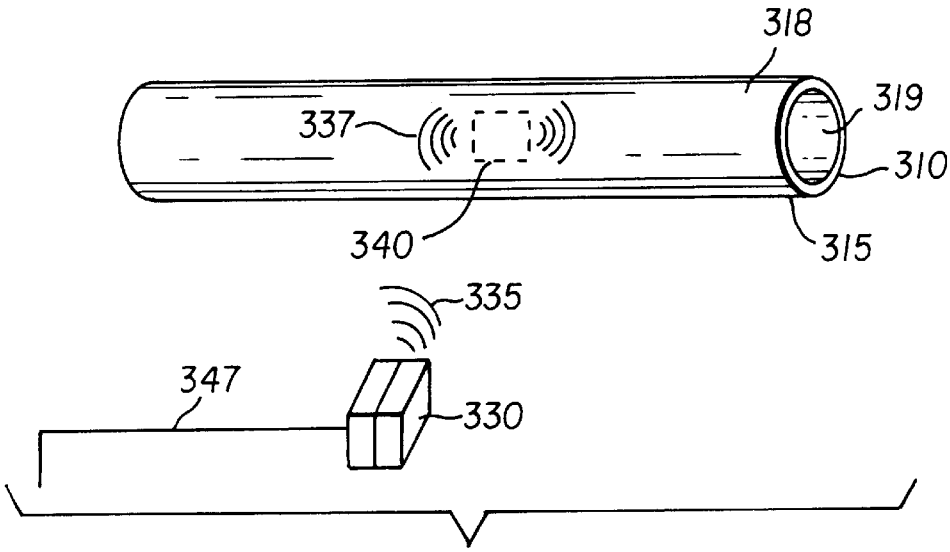
FIG. 4 is a view in perspective of the dye donor spool without the media ribbon for purposes of clarity, the dye donor spool having the transponder chip integrally connected thereto.
Figure 5:
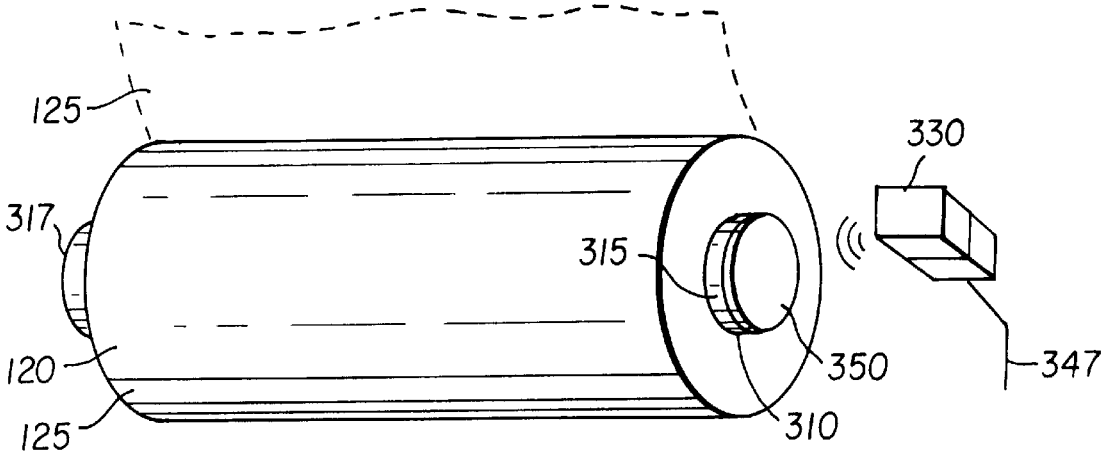
FIG. 5 is a view in perspective of a second embodiment dye donor spool, the second embodiment dye donor spool having an end-cap attached thereto covering the transponder chip.
Figure 6:
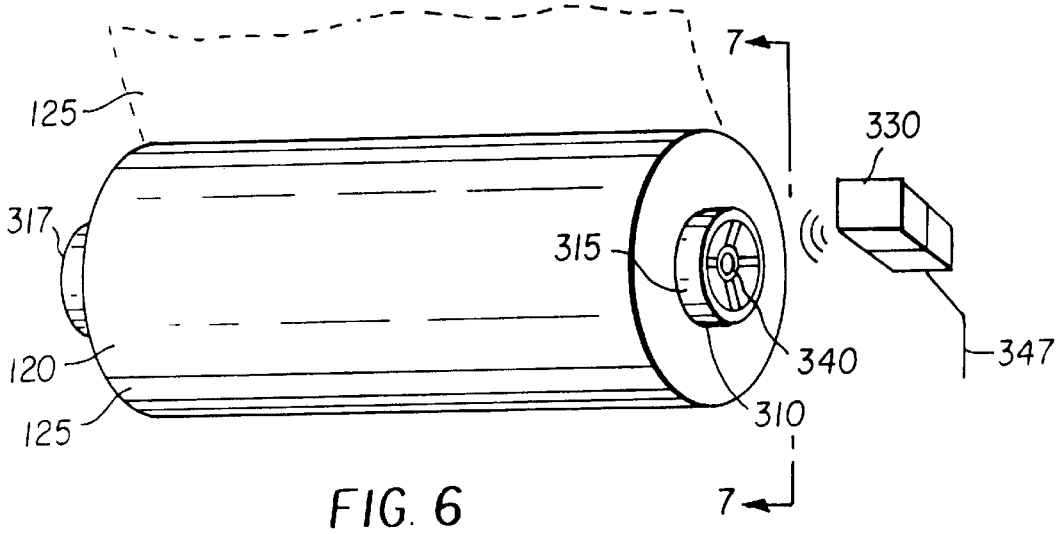
FIG. 6 is a view in perspective of the second embodiment dye donor spool, the second embodiment dye donor spool having the end-cap removed for purposes of showing the transponder chip.
Figure 7:
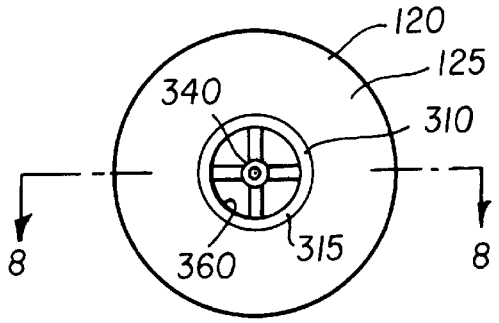
FIG. 7 is a view along section line 7—7 of FIG. 6.
Figure 8:
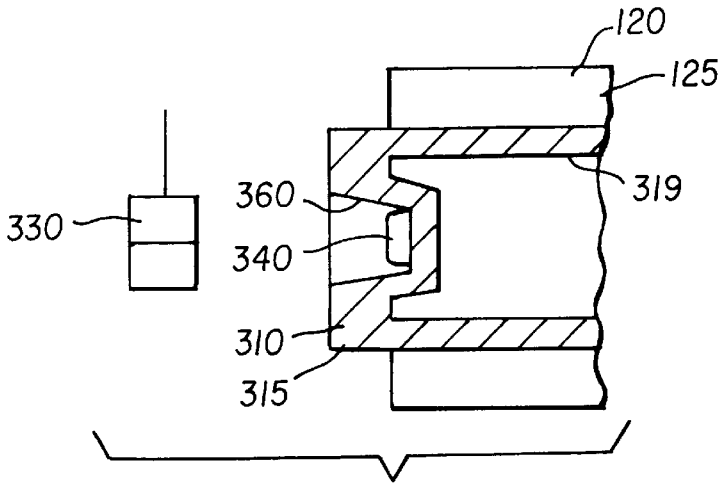
FIG. 8 is a view along section line 8—8 of FIG. 7.

Turning now to FIGS. 3 and 4, previously mentioned dye media supply spool 120 has media material 125 wound thereabout. Donor material 125 is preferably of a specific type uniquely matched to type of printer 10, for reasons disclosed hereinbelow. More specifically, supply spool 120 comprises a generally cylindrical shaft 310 having a first end portion 315 opposing a second end portion 317 and also having the supply of media material 125 wound about a wall 318 of shaft 310. Various light-weight materials may be used for shaft 310, such as cardboard or plastic, for reducing weight of shaft 310. Cylindrical shaft 310 has a longitudinally extending bore 319 therethrough for matingly receiving a rotatable spindle 320 belonging to printer 10. A radio frequency transceiver unit 330 is disposed in housing 30 proximate shaft 310. In this regard, transceiver unit 330 may be preferably located from between approximately 2 centimeters to approximately a meter or more away from shaft 310.

Referring again to FIGS. 3 and 4, transceiver unit 330 is capable of transmitting a first electromagnetic field 335 of a first predetermined frequency, for reasons disclosed presently. Transceiver 330 is also capable of sensing a second electromagnetic field 337 of a second predetermined frequency, for reasons disclosed presently. In this regard, transceiver 330 may transmit a first electromagnetic field 335 having a preferred first predetermined frequency of approximately 125 kHz. Such a transceiver unit 330 may be a Model "U2270B" transceiver available from Vishay-Telefunken Semiconductors, Incorporated located in Malvern, Pa., U.S.A.

Referring yet again to FIGS. 3 and 4, a transponder 340 is integrally connected to shaft 310, such as being embedded in wall 318 of shaft 310. Thus, transponder 340 is embedded in shaft 310, so that none of transponder 340 is visible to the naked eye in order to enhance aesthetic appearance of shaft 310. Transponder 340, which is capable of being oriented generally in alignment with transceiver 330, includes a non-volatile electrically erasable programmable read-only memory (EEPROM) semi-conductor chip. Transponder 340 has encoded data stored in the EEPROM indicative of media material 125. This data, which transponder 340 will broadcast to transceiver 330, is preferably stored in transponder 340 in binary bits. For this purpose, transponder 340 may be a Model "TL5550" transponder available from Vishay-Telefunken Semiconductors, Incorporated. By way of example only, and not by way of limitation, the data stored in transponder 340 may be any of the exemplary data displayed in the TABLE hereinbelow.

| Data Stored | Number of Bits | Description |
|---|---|---|
| Media Type Identifier | 8 | An 8 bit number encoding type of dye donor on the media supply spool. 255 different media types possible. |

-continued

| Data Stored | Number of Bits | Description |
|---|---|---|
| Product Code | 40 | 10 digit product code. Not required if Media Type Identifier is used. |
| Catalog Number | 32 | For example, R70 4085. Not required if Media Type Identifier is used. |
| Bar Code | 56 | Barcode for boxed product. May be less than 56 bits. For example, G491R0732894. |
| Spool Identifier | 24 | A 24 bit number used to determine when the dye media spool was manufactured. This Spool Identifier could be looked-up by the operator to determine manufacturing date. The Spool Identifier is a 24 bit number ranging from 0 to 16.7 thousand |
| Manufacture Date | 16 | 16 bit encoded date. Includes a 4 bit month, 5 bit day, and a 7 bit year. |
| Mean Donor Dye Density | 8 | 8 bit scaled value. Each media spool necessarily has a different fixed Mean Donor Dye Density value. |
| Donor Frame Counter | 8 | 8 bit counter recording how many pages are left on the donor roll. |
| Mean Donor Media Thickness | 4 | 4 bit mean thickness measure. Mean Donor Media Thickness used to adjust focus for within media spool media thickness deviations from typical. |

Moreover, a computer or microprocessor 345 is electrically coupled to transceiver 330, such as by means of conducting wire 347, for controlling printer 10. Microprocessor 345 processes data received by transceiver 330. In this regard, microprocessor 345 is capable of controlling various printer functions including, but not limited to, laser printhead power, exposure level to which donor material 125 is subjected, media inventory control and correct loading of media spool 120 into printer 10. In addition, it should be appreciated that there may be a plurality of transponders 340 for allowing transceiver 330 to poll and select a particular transponder 340 depending on donor data to be obtained.

Referring again to FIGS. 3 and 4, microprocessor 345 utilizes the data provided by transponder 340 to transceiver 330, either for customizing printer calibration for a specific donor roll or for simply reading calibration data already stored in transponder 340. For example, microprocessor 345 can automatically determine lot number, roll number and manufacturing date of media spool 120. Also, microprocessor 345 determines amount of donor material 125 present on media supply spool 120 at any time. This information would otherwise need to be manually entered into printer 10, thereby increasing printing costs and operator error. However, it may be appreciated from the disclosure herein that data usage is transparent to the operator of printer 10 and is automatically performed in "the background" to improve operator productivity because the operator need not manually enter data into printer 10. Moreover, the communications data link between transceiver 330 and microprocessor 345 may be by means of a well-known "RS232" port link or any other type of serial or parallel communication link.

Turning now to FIGS. 5, 6, 7 and 8, there is shown a second embodiment of supply spool 120. According to this second embodiment of supply spool 120, transponder 340 is mounted in first end portion 315 of shaft 310. An end-cap 350, which may be light-weight cardboard or plastic covering transponder 340 provides proper mechanical alignment of supply spool 120 within printer 10. More specifically, transponder 340 resides in a well 360 formed in first end portion 315 of shaft 310 and well 360 is covered by end-cap 350. In this second embodiment of the invention, transceiver 330 is preferably positioned generally in alignment with transponder 340. Additionally, microprocessor 345 can determine if media supply spool 120 is properly loaded into printer 10 by simply determining whether transponder 340 is generally aligned with transceiver 330. As stated hereinabove, an improperly loaded media spool 120 can damage the optical system of printer 10.

It may be appreciated from the teachings hereinabove that an advantage of the present invention is that use thereof eliminates manual data entry when loading a media ribbon supply spool into the printer. This is so because data stored in the transponder connected to the media ribbon supply spool is characteristic of the media ribbon wound about the supply spool. This data is broadcast by the transponder and automatically read by the transceiver.

It may be appreciated from the teachings hereinabove that another advantage of the present invention is that use thereof automatically determines number of pages (i.e., frames) remaining on the media spool. This is so because the donor frame counter that is included as data in the transponder provides an 8 bit counter that records how many pages are left on the dye media supply spool. This counter is decremented each time a frame is used. Automatic determination of number of pages remaining on a partially used media is important because it is often necessary to exchange a partially used roll of media for a full roll of media for overnight printing when the printer operates unattended.

It may be appreciated from the teachings hereinabove that yet another advantage of the present invention is that use thereof allows for optimum high quality image reproduction by allowing automatic calibration of the printer according to the specific type of media ribbon loaded therein. This reduces need for a plurality of pre-press proofs. This is so because the transponder belonging to the media ribbon supply spool informs the printer, by means of the second electromagnetic field, of the type of media ribbon loaded into the printer, so that the printer self-adjusts to provide optimal printing based on specific type of media ribbon loaded into the printer.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention. For example, the invention is usable wherever it is desirable to characterize a spool of material in order to calibrate an apparatus intended to accommodate the spool of material. As a further example, the invention is applicable to any image processor, such as an ink-jet printer. Also, as yet another example, the dye donor may have dye, pigments, or other material which is transferred to the thermal print media.

As is evident from the foregoing description, certain other aspects of the invention are not limited to the particular details of the embodiments illustrated, and it is therefore contemplated that other modifications and applications will occur to those skilled in the art. It is accordingly intended that the claims shall cover all such modifications and applications as do not depart from the true spirit and scope of the invention.

Therefore, what is provided is a printer with media supply spool adapted to sense type of donor, and method of assembling same.

PARTS LIST

10 printer
20 thermal print media
30 housing
40 door
50*a* lower print media sheet supply tray
50*b* upper print media sheet supply tray
60*a* lower media lift cam
60*b* upper media lift cam
70*a* lower media roller
70*b* lower media roller
70*b* upper media roller
80 media guide
90 media guide rollers
100 media staging tray
105 passageway
110 imaging drum
120 dye media supply spool
125 media material/ribbon
130 media carousel
140 cut dye donor sheets
150 media drive mechanism
160 media drive rollers
170 media knife assembly
175 media knife blades
180 laser assembly
190 laser diodes
200 fiber optic cables
210 distribution block
220 printhead
230 chute
240 waste bin
250 transport mechanism
260 binding assembly
265 media entrance door
267 media exit door
300 media stop
310 shaft
315 first end portion (of shaft)
317 second end portion (of shaft)
318 wall (of shaft)
319 bore
320 spindle
330 transceiver
335 first electromagnetic field
337 second electromagnetic field
340 transponder
345 microprocessor
347 conducting wire
350 end-cap
360 well

What is claimed is:

1. A printer adapted to sense type of media disposed therein, comprising:

(a) a transceiver for transmitting a first electromagnetic field and for sensing a second electromagnetic field; and (b) a memory spaced-apart from said transceiver and having data stored therein indicative of the type of media, said memory capable of receiving the first electromagnetic field to power said memory and generating the second electromagnetic field in response to the first electromagnetic field received thereby, the second electromagnetic field being characteristic of the data stored in said memory.

2. The printer of claim 1, wherein said memory is a read/write memory.

3. The printer of claim 1, further comprising a laser printhead for thermally activating the media.

4. A printer adapted to sense type of a media disposed therein, comprising:

(a) a printhead;

(b) a transceiver unit in association with said printhead for transmitting a first electromagnetic field and for sensing a second electromagnetic field;

(c) a supply spool spaced-apart from said transceiver, said supply spool having a supply of the media wound thereabout; and (d) a transponder integrally connected to said supply spool and having data stored therein indicative of the type of media, said transponder capable of receiving the first electromagnetic field to power said transponder and generating the second electromagnetic field in response to the first electromagnetic field received thereby, the second electromagnetic field being characteristic of the data stored in said transponder, whereby said transceiver unit senses the second electromagnetic field as said transponder generates the second electromagnetic field.

5. The printer of claim 4, wherein said transponder is a read/write memory semi-conductor chip.

6. The printer of claim 4, wherein said transceiver transmits the first electromagnetic field at a predetermined first radio frequency.

7. The printer of claim 6, wherein said transponder generates the second electromagnetic field at a predetermined second radio frequency.

8. The printer of claim 4, wherein said printhead is a laser printhead for thermally activating the media.

9. A printer adapted to sense type of a media disposed ribbon therein, the media ribbon capable of being thermally activated to transfer dye therefrom, comprising:

(a) a laser printhead for thermally activating the media ribbon;

(b) a transceiver unit in association with said printhead for transmitting a first electromagnetic field of a predetermined first radio frequency and for sensing a second electromagnetic field of a predetermined second radio frequency;

(c) a media ribbon supply spool spaced-apart from said transceiver, said supply spool having a supply of the media ribbon wound thereabout;

(d) a read/write memory semi-conductor chip integrally connected to said supply spool and having encoded data stored therein indicative of the type of the media ribbon, said chip capable of receiving the first electromagnetic field to power said chip and capable of generating the second electromagnetic field as the chip is powered, the second electromagnetic field being characteristic of the data stored in said chip so that the data is subsumed in the second electromagnetic field, whereby said transceiver unit senses the second electromagnetic field as said chip generates the second electromagnetic field; and (e) a microprocessor coupled to said transceiver for controlling the printer in accordance with the data subsumed in the second electromagnetic field.

10. The printer of claim 9, further comprising a media ribbon media drive mechanism engaging the media ribbon for driving the media ribbon into heat transfer communication with said printhead, so that said printhead thermally activates the media ribbon.

11. A method of assembling a printer adapted to sense type of media disposed therein, comprising the steps of:

(a) providing a transceiver for transmitting a first electromagnetic field and for sensing a second electromagnetic field; and (b) disposing a memory spaced-apart from the transceiver, the memory having data stored therein indicative of the type of media, the memory capable of receiving the first electromagnetic field to power said memory and generating the second electromagnetic field in response to the first electromagnetic field received thereby, the second electromagnetic field being characteristic of the data stored in the memory.

12. The method of claim 11, wherein the step of disposing a memory comprises the step of disposing a read/write memory.

13. The method of claim 11, further comprising the step of providing a laser printhead for thermally activating the media.

14. A method of assembling a printer adapted to sense type of a media disposed therein, comprising the steps of:

(a) providing a printhead;

(b) disposing a transceiver unit relative to the printhead for transmitting a first electromagnetic field and for sensing a second electromagnetic field;

(c) disposing a supply spool spaced-apart from the transceiver, the supply spool having a supply of the media wound thereabout; and (d) integrally connecting a transponder to the supply spool, the transponder having data stored therein indicative of the type of media, the transponder capable of receiving the first electromagnetic field to power said transponder and generating the second electromagnetic field in response to the first electromagnetic field received thereby, the second electromagnetic field being characteristic of the data stored in the transponder, whereby the transceiver unit senses the second electromagnetic field as the transponder generates the second electromagnetic field.

15. The method of claim 14, wherein the step of disposing a transponder comprises the step of disposing a read/write memory semi-conductor transponder.

16. The method of claim 14, wherein the step of disposing a transceiver comprises the step of disposing a transceiver capable of transmitting the first electromagnetic field at a predetermined first radio frequency.

17. The method of claim 16, wherein the step of disposing a transponder comprises the step of disposing a transponder capable of generating the second electromagnetic field at a predetermined second radio frequency.

18. The method of claim 14, wherein the step of providing a printhead comprises the step of providing a laser printhead for thermally activating the media.

19. A method of assembling a printer adapted to sense type of a media disposed ribbon therein, the media ribbon capable of being thermally activated to transfer dye therefrom, comprising the steps of:

(a) providing a laser printhead for thermally activating the media ribbon;

(b) disposing a transceiver unit relative to the printhead for transmitting a first electromagnetic field of a predetermined first radio frequency and for sensing a second electromagnetic field of a predetermined second radio frequency;

(c) disposing a media ribbon supply spool spaced-apart from the transceiver, the supply spool having a supply of the media ribbon wound thereabout;

(d) integrally connecting a read/write memory semiconductor chip to the supply spool, the chip having encoded data stored therein indicative of the type of the media ribbon, the chip capable of receiving the first electromagnetic field to power the chip and capable of generating the second electromagnetic field as the chip is powered, the second electromagnetic field being characteristic of the data stored in the chip so that the data is subsumed in the second electromagnetic field, whereby the transceiver unit senses the second electromagnetic field as the chip generates the second electromagnetic field; and (e) coupling a microprocessor to the transceiver for controlling the printer in accordance with the data subsumed in the second electromagnetic field.

20. The method of claim 19, further comprising the step of disposing a media drive mechanism engaging the media ribbon for driving the media ribbon into heat transfer communication with the printhead, so that the printhead thermally activates the media ribbon.

* * * * *